US009234640B2

(12) United States Patent
Geralds et al.

(10) Patent No.: US 9,234,640 B2
(45) Date of Patent: Jan. 12, 2016

(54) WALL-WASH FIXTURE FOR DIRECTIONAL LIGHT SOURCES

(75) Inventors: Tony Geralds, Indianapolis, IN (US); Martin Lee, Zionsville, IN (US)

(73) Assignee: Juno Manufacturing, LLC, Des Plaines, IL (US)

( * ) Notice: Subject to any disclaimer, the term of this patent is extended or adjusted under 35 U.S.C. 154(b) by 570 days.

(21) Appl. No.: 13/599,659

(22) Filed: Aug. 30, 2012

(65) Prior Publication Data

US 2014/0063812 A1 Mar. 6, 2014

(51) Int. Cl.

| | |
|---|---|
| ***F21V 7/00*** | (2006.01) |
| ***F21S 8/00*** | (2006.01) |
| ***F21S 8/02*** | (2006.01) |
| ***F21V 7/10*** | (2006.01) |

(52) U.S. Cl.

CPC ..... *F21S 8/026* (2013.01); *F21V 7/0033* (2013.01); *F21V 7/10* (2013.01)

(58) Field of Classification Search

CPC ... F21V 7/0033; F21V 7/0041; F21V 7/0025; F21V 7/0008; F21V 7/0016; F21V 7/09; F21V 3/00; F21V 13/04; F21V 5/04; F21S 8/02; F21S 8/026; F21S 8/04

USPC ..... 362/298, 296.01, 350, 147, 364, 297, 362/348, 346, 328, 247, 248, 341–344, 362/249.02

See application file for complete search history.

(56) References Cited

U.S. PATENT DOCUMENTS

| | | | | |
|---|---|---|---|---|
| 6,698,912 | B2 * | 3/2004 | Yang | 362/516 |
| 8,333,488 | B2 * | 12/2012 | Bailey | 362/298 |
| 8,403,530 | B2 * | 3/2013 | Singer et al. | 362/243 |
| 8,602,602 | B2 * | 12/2013 | Anaokar et al. | 362/297 |
| 2008/0084697 | A1 * | 4/2008 | Eberhard | 362/297 |

OTHER PUBLICATIONS

Juno Lighting, LLC., *Indy™ Performance Series LED Commercial Downlights* Catalog, Feb. 2012 (44 pages).

* cited by examiner

*Primary Examiner* — Jong-Suk (James) Lee
*Assistant Examiner* — William N Harris
(74) *Attorney, Agent, or Firm* — Locke Lord LLP

(57) ABSTRACT

A downlight reflector assembly for a light-emitting diode (LED) light source includes a kicker reflector and an upper scoop. The kicker reflector has a reflector wall extending between a small top opening and a large bottom opening along a transverse axis. The reflector wall has an internal surface with an illuminated area and a non-illuminated area. The upper scoop is mounted in the small top opening of the kicker reflector and has a reflective multi-faceted surface with a concave curvature relative to the LED light source. The upper scoop extends from the top opening in part along the transverse axis and covering a portion of the top opening. The multi-faceted surface faces both of the illuminated area of the kicker reflector and the top opening for reflecting light rays received through the top opening towards the illuminated area.

18 Claims, 7 Drawing Sheets

WALL-WASH FIXTURE FOR DIRECTIONAL LIGHT SOURCES

FIELD OF THE INVENTION

This invention is directed generally to lighting systems, and, more particularly, to a reflector having a scoop for re-directing directional light in a downlight fixture.

BACKGROUND OF THE INVENTION

Lighting designers evaluate the quality of a recessed light fixture based in part on how well the fixture distributes light on a wall adjacent to the fixture. This type of fixture is typically referred to as a downlight wall-wash. Ideally, the lighting designers strive to achieve uniform light distribution on the wall and smooth transition down the wall toward the floor. For example, multiple wall washers are installed next to each other to eliminate arch-type of light distribution (also known as "scallops") and to create a uniform wall pattern horizontally and vertically across the wall, with no variation in foot-candles.

Wall-wash reflectors have been traditionally designed with a reflector shape intended to support a multi-directional light source in which light is generated in all directions, e.g., incandescent, high-intensity discharge (HID), and compact-fluorescent (CFL) light sources. For example, traditional reflectors had a parabolic shape in which a window was cut out and replaced with a re-directing partial parabolic kicker. The light source was located at the center of the parabola and the kicker was located on a side of the reflector. The result was that a portion of the light was directed towards the floor and a portion of the light was directed up toward the wall.

As light-emitting diodes ("LEDs") have become a viable source for downlights, manufacturers have continued to design wall-wash reflectors using the traditional parabolic-shape approach. Specifically, the LED light source was moved from the center of the parabola to the top of the parabola, and additional side reflective kicker was included. The result, however, was that the majority of the light was reflected toward the wall into a small circular "hot spot" pattern.

SUMMARY OF THE INVENTION

In an implementation of the present invention, a downlight fixture includes a parabolic reflector, a small-faceted scoop, and a LED light source. The scoop is mounted to a top end of the parabolic reflector and has a curvature for reflecting light, received from the LED light source, towards an opposing side of the parabolic reflector. The light is, then, reflected again from the parabolic reflector towards an upper area of an adjacent wall. The configuration of the downlight fixture achieves an evenly spread pattern on the wall with reduced (or eliminated) glare on a room side of the downlight fixture.

In another implementation of the present invention, a downlight reflector assembly for a LED light source includes a kicker reflector and an upper scoop. The kicker reflector has a reflector wall extending between a small top opening and a large bottom opening along a transverse axis. The reflector wall has an internal surface with an illuminated area and a non-illuminated area. The upper scoop is mounted in the small top opening of the kicker reflector and has a reflective multi-faceted surface with a concave curvature relative to the LED light source. The upper scoop extends from the top opening in part along the transverse axis and covering a portion of the top opening. The multi-faceted surface faces the illuminated area of the kicker reflector and the top opening for reflecting light rays received through the top opening towards the illuminated area.

In another alternative implementation of the present invention, a downlight fixture includes a LED light source for emitting directional light rays in a downward direction towards an illuminated target. The downlight fixture further includes a reflector assembly including a kicker reflector, a separator component, and a scoop. The kicker reflector has a reflector wall extending between a small top opening and a large bottom opening along a transverse axis. The reflector wall has an internal surface with an illuminated area and a non-illuminated area. The separator component is mounted within the kicker reflector between the illuminated area and the non-illuminated area. The scoop is mounted to the kicker reflector and has a semispherical shape with an internal reflective multi-faceted surface facing the illuminated area of the kicker reflector and the top opening for reflecting light rays received through the top opening towards the illuminated area.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

The invention may best be understood by reference to the following description taken in conjunction with the accompanying drawings.

DETAILED DESCRIPTION OF THE ILLUSTRATED EMBODIMENTS

Figure 1:
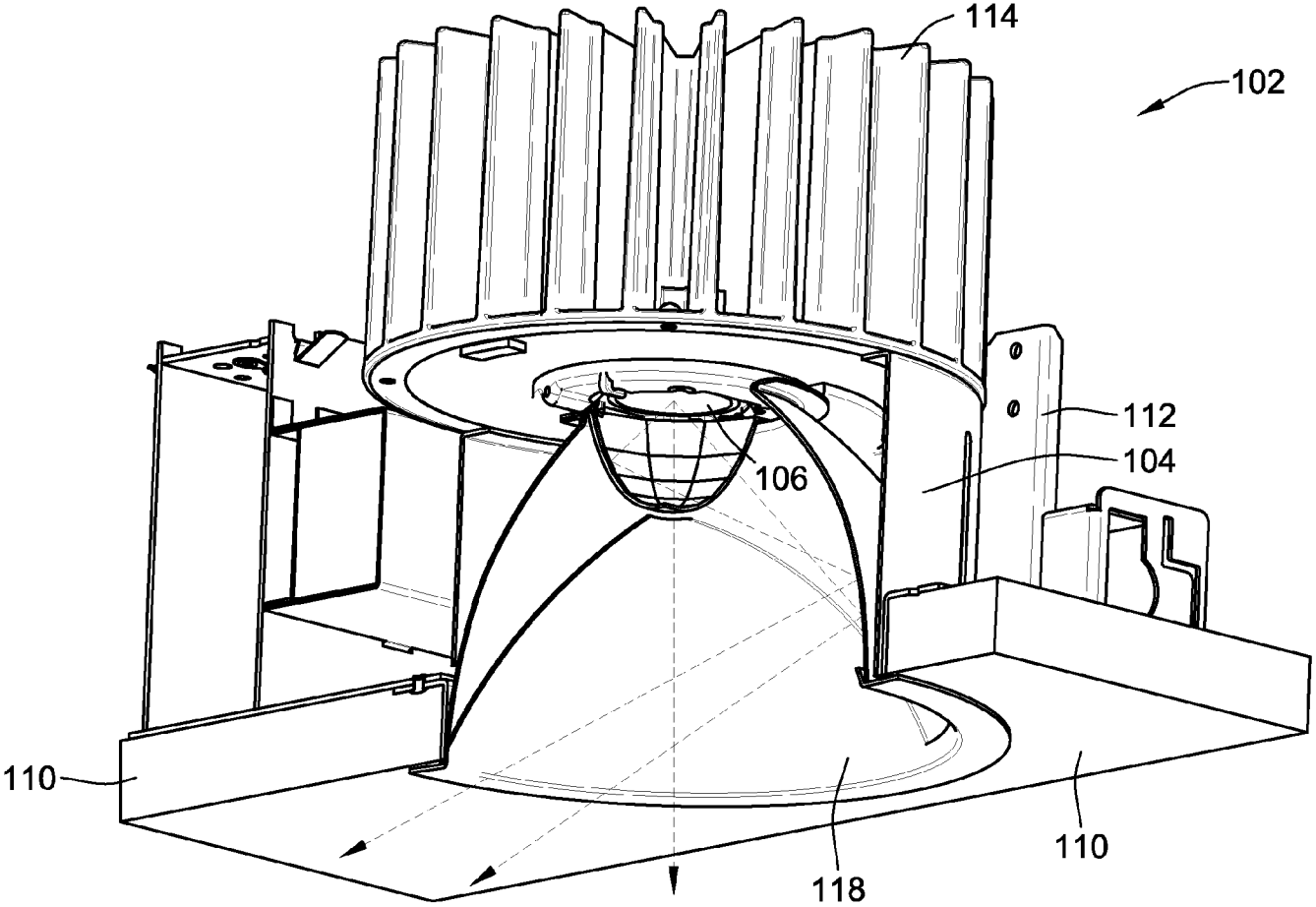
FIG. 1 is a perspective partial cut-away view of a downlight fixture.

Referring to FIG. 1, a downlight fixture 102 includes an optic housing 104, a light-emitting diode (LED) light source 106, and a downlight reflector assembly 118. The optic housing 104 is mountable to a ceiling 110 via an adjustable mounting bracket 112 and is attached to a heat sink 114. The LED light source 106 emits directional light that is directed towards an adjacent wall and a floor surface through the reflector assembly 118.

According to one example, the optic housing 104 is a commercial-grade housing that features an extra-low profile for easy installation in a variety of applications. According to another example, the heat sink 114 is directly integrated with the optic housing 104 to maintain LED junction temperatures below specified limits. Efficient thermal management, via the integrated heat sink, of the LED junction temperatures is helpful in achieving at least a 70% level of initial LED light output after about 50,000 hours.

The light source 106 is coupled to the optic housing 104 and, in one example, has a LED light engine that includes at least one LED. The LED light source 106 is used as a light source for general illumination, accent lighting, or any other commercial lighting application. According to one example, the LED light source 106 is a chip-on board LED light engine having a 12×12 array of multiple LEDs. The LEDs are under-driven for exceptional efficiency and for outputting light in the range of about 800 to 2,700 fixture lumens. The chip-on board LED light engine is a modular light engine that is easily replaceable and that helps approach 70 lumens per Watt (1 m/W) in efficacy, with various color temperatures, e.g., 2700K, 3000K, 3500K, and 4100K color temperatures, and a minimum color rendering index (CRI) of 80.

Figure 2A:
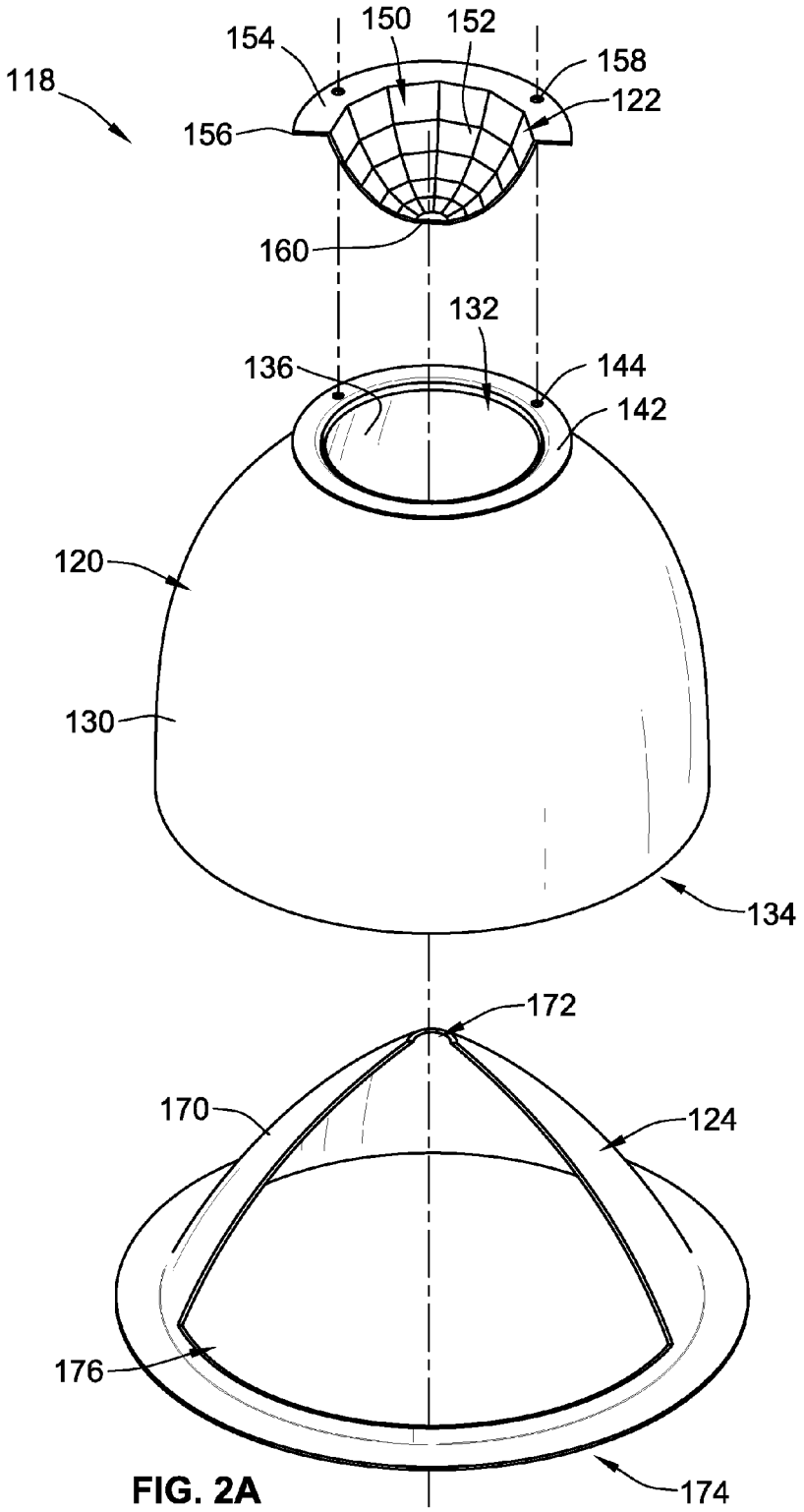
FIG. 2A is an exploded view of a downlight reflector assembly with a tubular kicker reflector.
Figure 2B:
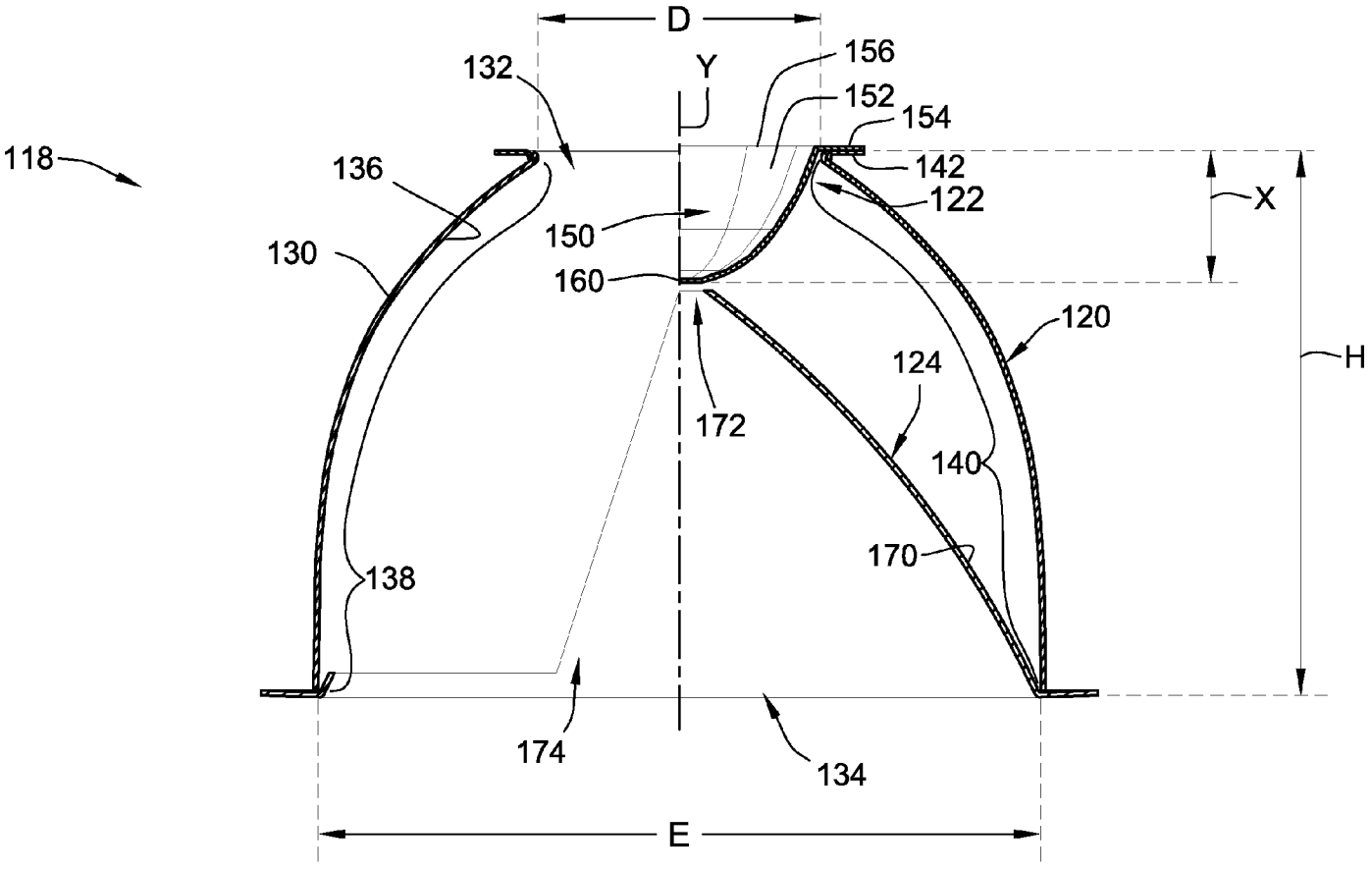
FIG. 2B is a cross-sectional view of the downlight reflector assembly of FIG. 2A.

Referring to FIGS. 2A and 2B, the reflector assembly 118 includes a kicker reflector 120, a scoop 122, and a lower cone 124. In general, the kicker reflector 120 is a specular or high reflectance white-painted parabolic reflector that captures emitted light from the scoop 122 and distributes the light toward an object being washed with the light, e.g., an adjacent wall. The kicker reflector 120 has a reflector wall 130 that is tubular shaped with a parabolic cross-section and extends from a small top opening 132 to a large bottom opening 134. The distance between the two openings 132, 134 is along a transverse axis Y and defines a height H of the kicker reflector 120. Both openings 132, 134 have a circular shape, with the top opening 132 having a diameter D and the bottom opening having a diameter E. According to one example, the height H may range from 3.9 inches to 5.6 inches and the diameter E may range from 4 inches to 8 inches. For example, the height H may be 4.7 inches and the diameter E may be 6 inches.

The reflector wall 130 has an internal surface 136 that includes an illuminated area 138 and a non-illuminated area 140. As described in more detail below in reference to FIG. 3, the illuminated area 138 receives light from the light source 106 and reflects the light towards the adjacent wall. The side of the kicker reflector 120 on which the illuminated area 138 is located is also referred to as the room side.

The kicker reflector 120 includes a mounting lip 142 extending along the periphery of the top opening 132 in a perpendicular orientation relative to the transverse axis Y. The mounting lip 142 includes mounting holes 144 for securing in place the scoop 122.

The scoop 122 is, generally, a specular cupped-formed object that captures the emitted light and transfers it towards the kicker reflector 120. As such, the scoop 122 redirects light that would otherwise be trapped, or lost, in an area behind the lower cone 124, i.e., the non-illuminated area 140. According to the illustrated embodiment, the scoop 122 has a semi-spherical shape and includes a reflective multi-faceted surface 150 with a concave curvature. The multi-faceted surface 150 includes a plurality of rectangular facets 152 for redirecting light towards the illuminated area 138 of the kicker reflector 120.

The scoop 122 further includes an upper lip 154 that extends along the periphery of a top end 156 of the multi-faceted surface 150. The top end 156 of the multi-faceted surface 150 has a semicircular shape that matches a respective half of the top opening 132. The upper lip 154 includes through holes 158 that match the position of the mounting holes 144 for securing the scoop 122 to the kicker reflector 120.

The scoop 122 also extends from the top opening 132 in part within the kicker reflector 120 along the transverse axis Y and covers a portion of the top opening 132. The scoop 122 extends a distance X, along the transverse axis Y, from the upper lip 154 to a bottom end 160. According to the illustrated example, the distance X is less than half of the height H of the kicker reflector 120. Additionally, the scoop 122 covers a right half of the top opening 132 and extends from an edge of the upper lip 154 to the transverse axis Y.

The lower cone 124 has a cone wall 170 extending from an upper opening 172 to a lower opening 174. The upper opening 172 is located below and near the bottom end 160 of the scoop 122. The lower opening 174 is adjacent to and overlapping within the bottom opening 134. The lower cone 124, via the cone wall 170, acts as a separator component that is mounted within the kicker reflector 120 as a shield between the illuminated area 138 and the non-illuminated area 140. Thus, the area between (a) the kicker reflector 120 and (b) the cone wall 170 and scoop 122 is shielded from contact with most, if not all, light rays. The cone wall 170 includes a wall opening 176 that is adjacent to the illuminated area 138 of the kicker reflector 120 for allowing light rays to travel from the from the scoop 122 towards the illuminated area 138 of the kicker reflector 120.

Figure 3:
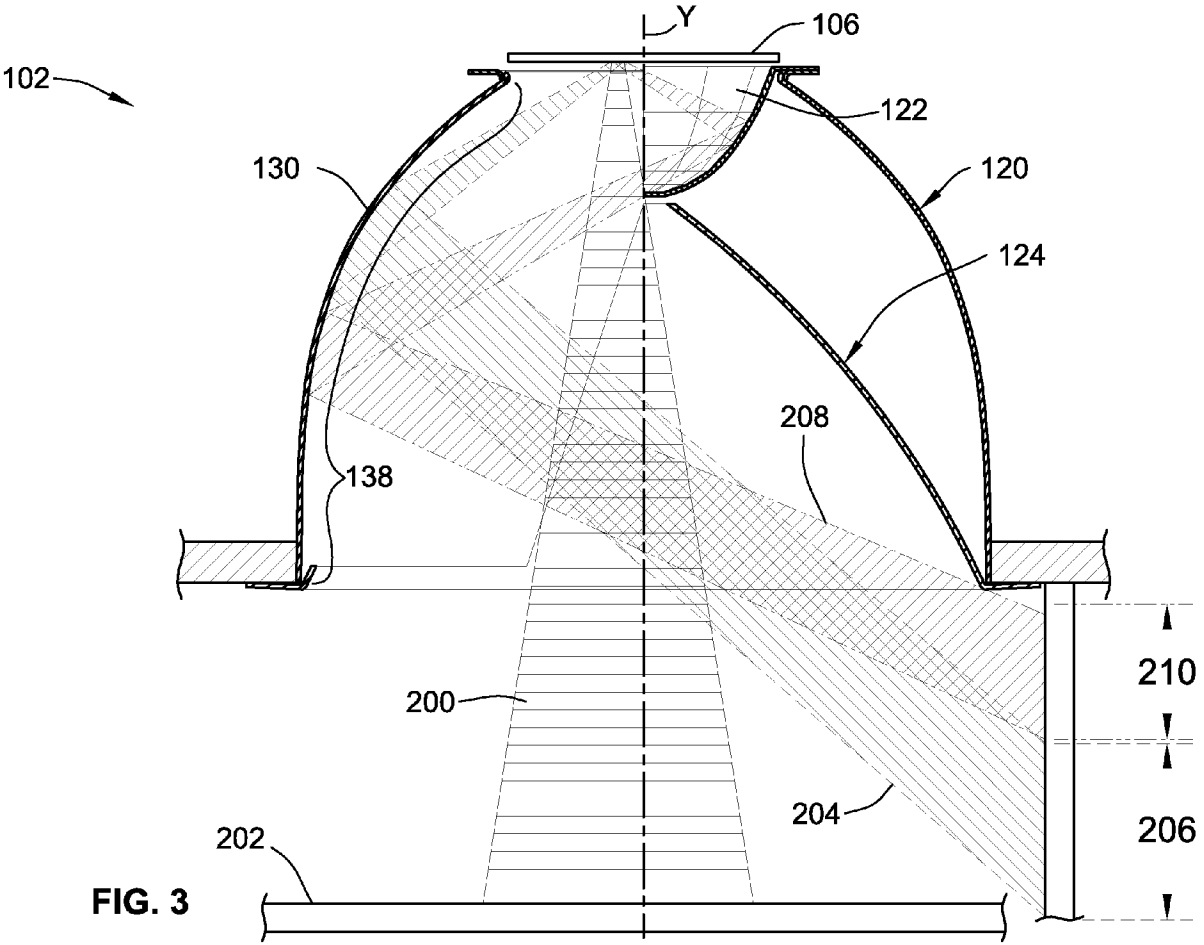
FIG. 3 is a diagrammatic illustration of light emitted by a LED light source and being reflected by the downlight reflector assembly of FIG. 2B.

Referring to FIG. 3, light is emitted by the light source 106 and spread into three light beams for illuminating (or "painting") three target surfaces. A first light beam 200 is emitted to paint a floor surface 202 on the room side of the kicker reflector 120. Light rays of the first light beam 200 travel a path that is generally straight down towards the floor surface 202 and has minimal, if any, contact with internal surfaces of the kicker reflector 120, the scoop 122, or the lower cone 124. The first light beam 200 paints an even light pattern on the floor surface 202 and eliminates the need to alter spacing criteria for additional downlight reflectors. In other words, the downlight fixture 102 serves a dual purpose for illuminating both a floor surface and a wall surface (not just the wall surface). The even light pattern is generally a uniformly spread pattern that is not focused in a small circular "hot spot" pattern. According to one example, the first light beam 200 is emitted with a 40 degree cut-off angle.

A second light beam 204 is emitted to paint a lower-wall surface 206. Light rays of the second light beam 204 travel a path in which the light rays are directed to the illuminated area 138 of the kicker reflector 120 and, then, reflected towards the lower-wall surface 206. The second light beam 204 provides an even light pattern on the lower-wall surface 206.

A third light beam 208 is emitted to paint an upper-wall surface 210. Light rays of the third light beam 208 travel a path in which the light rays are directed to the multi-faceted surface 150 of the scoop 122, reflected towards the illuminated area 138 of the kicker reflector 120, and, then, reflected towards the upper-wall surface 210. The third light beam 208 provides an even light pattern on the upper-wall surface 210. The area of contact between the third light beam 208 and the kicker reflector 120 is lower than the area of contact between the second light beam 204 and the kicker reflector 120. The lower area of contact associated with the third light beam 208 is achieved based on the redirection by the multi-faceted surface 150. In turn, the lower area of contact results in a higher illuminated surface 210 (relative to the lower illuminated surface 206) on the adjacent illuminated wall.

Figure 4A:
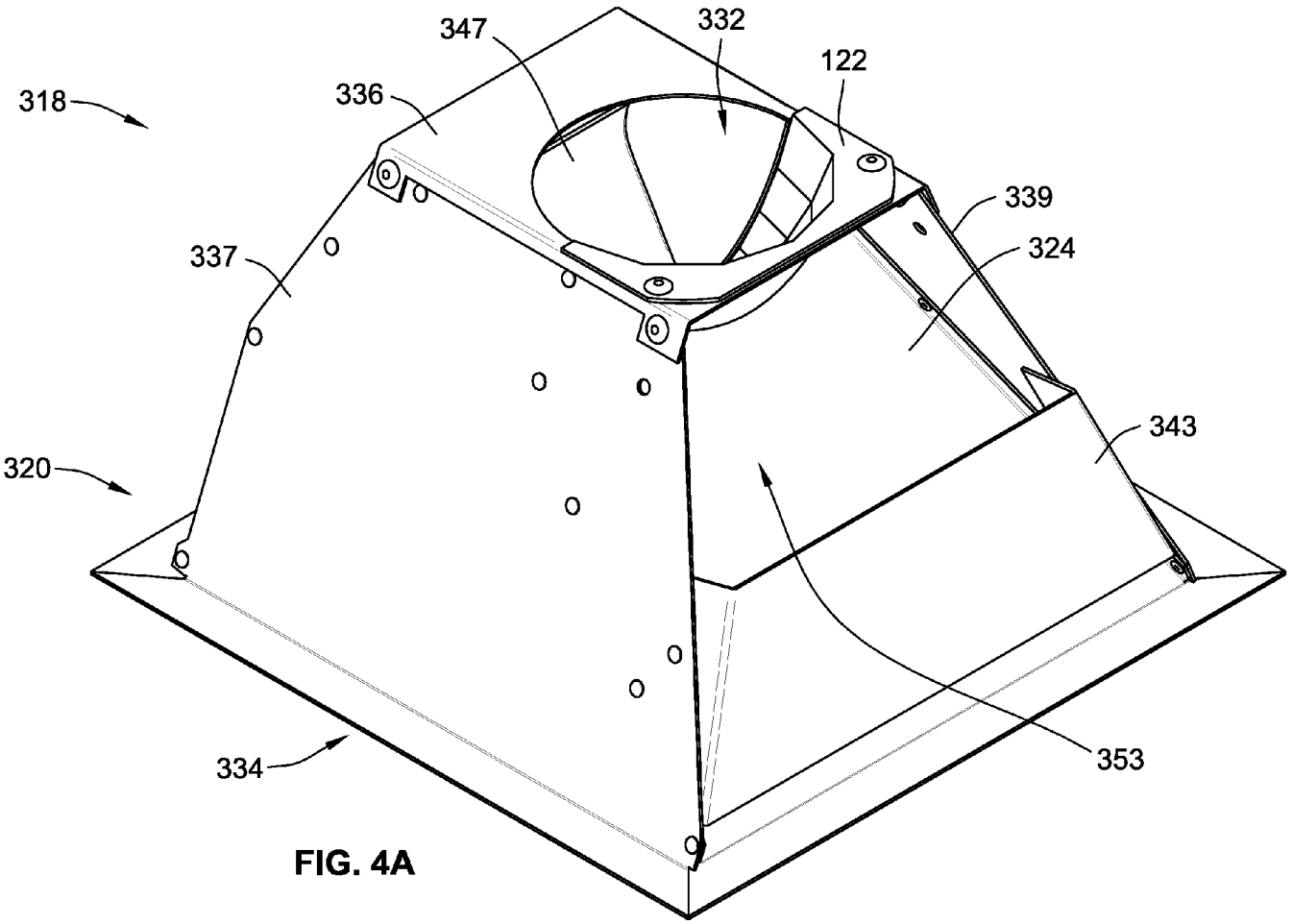
FIG. 4A is a perspective view of a downlight reflector assembly with a rectangular kicker reflector.
Figure 4B:
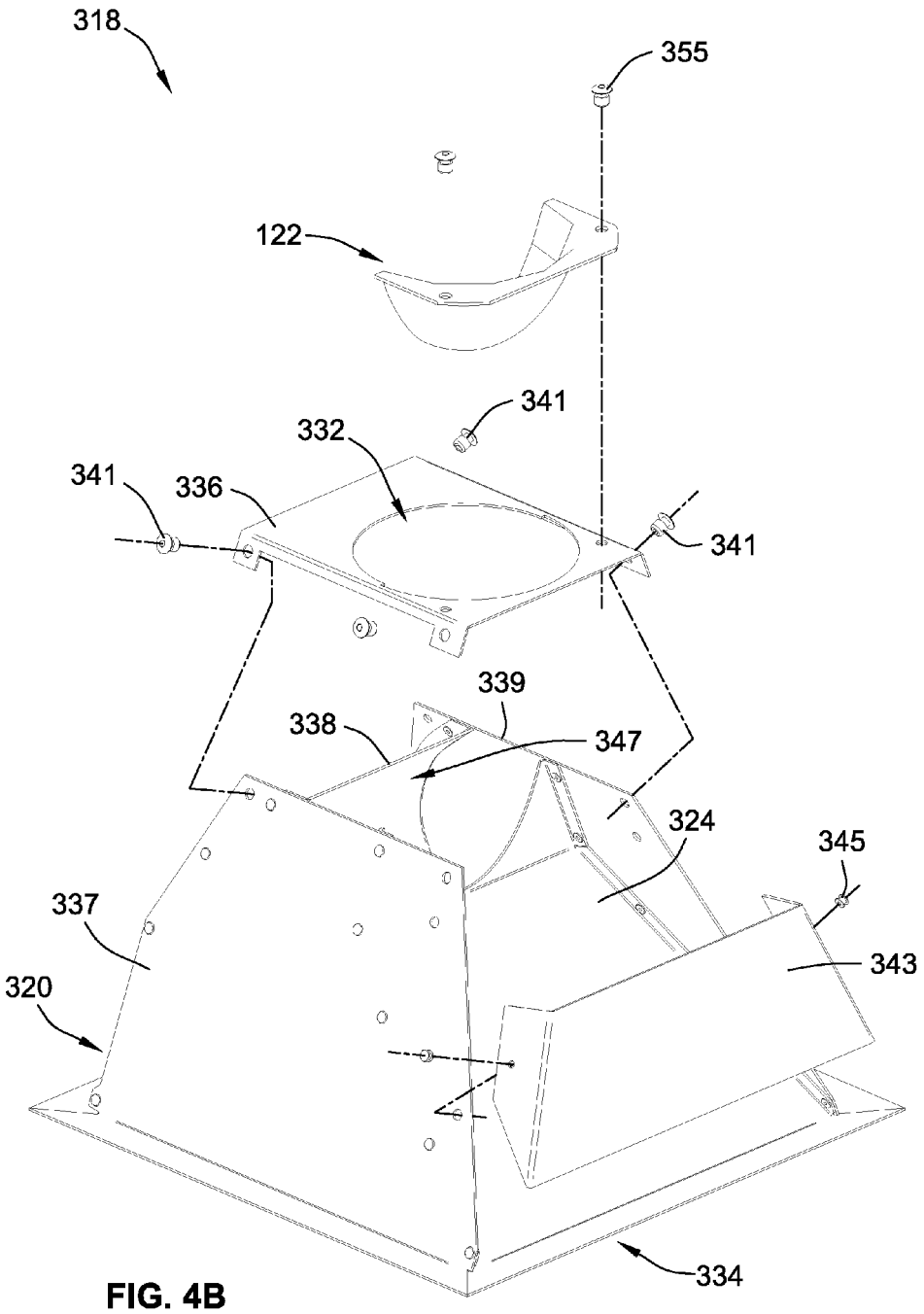
FIG. 4B is an exploded view of the downlight reflector assembly of FIG. 4A.

Referring to FIGS. 4A and 4B, the scoop 122 is mounted in a downlight reflector assembly having a rectangular configuration 318, in contrast to the tubular configuration 118 described above in reference to FIGS. 1-3. Similar to the tubular configuration 118, the rectangular configuration 318 includes a kicker reflector 320, the scoop 122, and a shield plate 324. The kicker reflector 320 of the rectangular configuration 318 functions similarly to the kicker reflector 120 of the tubular configuration 118, the scoop 122 is identical in both configurations 118, 318, and the shield plate 324 functions similarly to the lower cone 124. Thus, geometrically, the scoop 122 can be used in other configurations than the tubular configuration.

In the rectangular configuration, the kicker reflector 320 includes a plurality of plates mounted to each other in a rectangular arrangement and a pair of openings, including a top opening 332 and a bottom opening 334. The top opening 332 is circular, while the bottom opening 334 is rectangular. The plates includes a shield plate, 324, a top plate 336, a front plate 337, a reflective plate 338, and a back plate 339. The scoop 122 is mounted to the top plate 330 using fastening screws 355.

The top plate 336 is mounted to the front plate 337 and the back plate 339 using mounting screws 341. The front plate 337 and back plate 339 are separated by and coupled to each other by the reflective plate 338 and the shield plate 324. The bottom opening 334 separates the plates 324, 337-339 at the bottom of the kicker reflector 320. Furthermore, a supporting plate 343 is attached via screws 345 to the front and back plates 337, 339 for structural rigidity.

The reflective plate 338 has a parabolic cross-section for reflecting light beams towards a wall surface. As such an internal surface of the reflective plate 338 is an illuminated area 347 and functions similarly to the illuminated area 138 of the tubular reflector kicker 120.

The shield plate 324 has a top end 349 positioned below the scoop 122 and a bottom end 351 adjacent to the bottom opening 334 of the kicker reflector 320. The area between the shield plate 324 and the supporting plate 343 is a non-illuminated area 353, because the shield plate 324 and the scoop 122 block most, if not all, light rays received within the kicker reflector 320. The blocking of the light rays is achieved by having the shield plate 324 positioned between the illuminated area 347 and the non-illuminated area 353 (see also FIG. 5).

Figure 5:
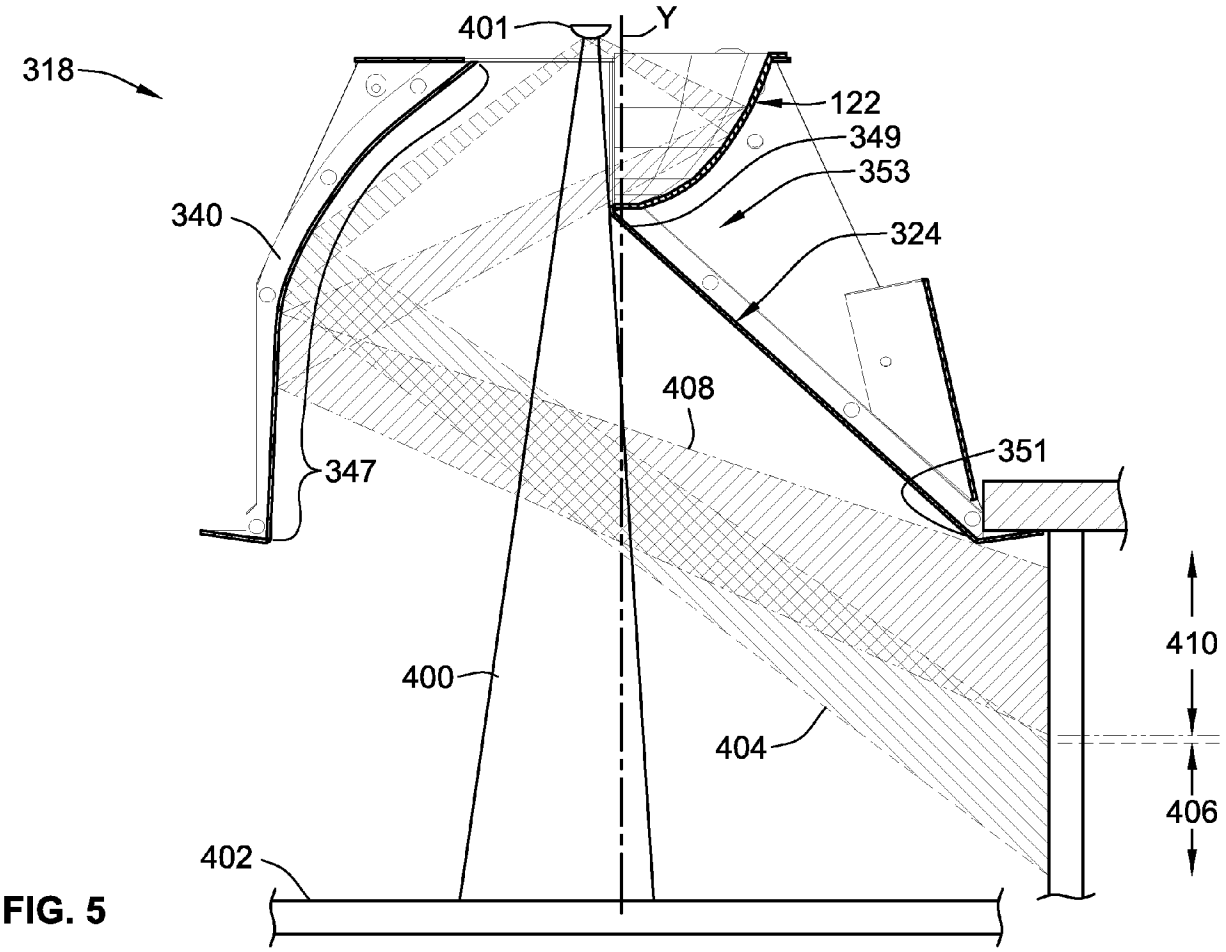
FIG. 5 is a cross-sectional illustration showing light emitted by a LED light source and being reflected by the downlight reflector assembly of FIG. 4A.

Referring to FIG. 5, similarly (although not identically) to the tubular configuration 118 illustrated in FIG. 3, the rectangular configuration 318 achieves three light beams emitted by a LED 401 for painting respective floor and wall surfaces. For example, a first light beam 400 paints a floor surface 402, a second light beam 404 paints a lower-wall surface 406, and a third light beam 408 paints an upper-wall surface 410. The reflective plate 340 reflects the second and third light beams 404, 408 towards the wall surfaces 406, 410. The second light beam 404 is received directly from the LED 401 and the third light beam 410 is received directly from the scoop 122.

While particular embodiments, aspects, and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. A downlight reflector assembly for a light-emitting diode (LED) light source, the reflector assembly comprising:

a kicker reflector having a reflector wall extending between a small top opening and a large bottom opening along a transverse axis, the reflector wall having an internal surface with an illuminated area and a non-illuminated area;

an upper scoop mounted in the small top opening of the kicker reflector and having a reflective multi-faceted surface with a concave curvature relative to the LED light source, the upper scoop extending from the top opening in part along the transverse axis and covering a portion of the top opening, the multi-faceted surface facing the illuminated area of the kicker reflector and the top opening for reflecting light rays received through the top opening towards the illuminated area; and a cone mounted within the kicker reflector and having a cone wall extending from an upper opening to a lower opening, the upper opening of the cone being located below the upper scoop and the lower opening of the cone being adjacent to the bottom opening of the kicker reflector, the cone wall including a wall opening adjacent to the illuminated area of the kicker reflector for allowing light rays to travel towards the illuminated area.

2. The downlight reflector assembly of claim 1, wherein the kicker reflector has a tubular shape.

3. The downlight reflector assembly of claim 2, wherein the tubular shape has a parabolic cross-section.

4. The downlight reflector assembly of claim 1, wherein the kicker reflector has a rectangular shape.

5. A downlight reflector assembly for a light-emitting diode (LED) light source, the reflector assembly comprising:

a kicker reflector having a reflector wall extending between a small top opening and a large bottom opening along a transverse axis, the reflector wall having an internal surface with an illuminated area and a non-illuminated area; and an upper scoop mounted in the small top opening of the kicker reflector and having a reflective multi-faceted surface with a concave curvature relative to the LED light source, the upper scoop extending from the top opening in part along the transverse axis and covering a portion of the top opening, the multi-faceted surface facing the illuminated area of the kicker reflector and the top opening for reflecting light rays received through the top opening towards the illuminated area, wherein the reflector wall includes a shield plate having a top end below the upper scoop and a bottom end adjacent to the bottom opening of the kicker reflector, the shield plate being located between the illuminated area and the non-illuminated area of the kicker reflector to block light rays from traveling towards the non-illuminated area.

6. The downlight reflector assembly of claim 1, wherein both the top opening and the bottom opening have a circular shape.

7. The downlight reflector assembly of claim 1, wherein the bottom opening has a rectangular shape.

8. The downlight reflector assembly of claim 1, wherein the upper scoop covers half of the top opening.

9. The downlight reflector assembly of claim 1, wherein the upper scoop extends along the transverse axis a distance that is less than half of a transverse distance between the top opening and the bottom opening.

10. A downlight fixture comprising:

a light-emitting diode (LED) light source for emitting directional light rays in a downward direction towards an illuminated target; and a reflector assembly including a kicker reflector having a reflector wall extending between a small top opening and a large bottom opening along a transverse axis, the reflector wall having an internal surface with an illuminated area and a non-illuminated area, a separator component mounted within the kicker reflector between the illuminated area and the non-illuminated area, and a scoop mounted to the kicker reflector and having a semispherical shape with an internal reflective multi-faceted surface facing both the illuminated area of the kicker reflector and the top opening for reflecting light rays received through the top opening towards the illuminated area, wherein the separator component is a cone mounted within the kicker reflector and having a cone wall extending from an upper opening to a lower opening, the upper opening of the cone being located below the scoop and the lower opening of the cone being adjacent to the bottom opening of the kicker reflector, the cone wall including a wall opening adjacent to the illuminated area of the kicker reflector for allowing light rays to travel towards the illuminated area.

11. The downlight fixture of claim 10, wherein the scoop extends from the top opening in part along the transverse axis and covers a portion of the top opening.

12. The downlight fixture of claim 11, wherein the scoop extends along the transverse axis a distance that is less than half of a transverse distance between the top opening and the bottom opening.

13. The downlight fixture of claim 10, wherein the top opening of the kicker reflector is located adjacent to the LED light source.

14. The downlight fixture of claim 10, wherein the kicker reflector has a tubular shape.

15. The downlight fixture of claim 14, wherein the tubular shape has a parabolic cross-section.

16. The downlight fixture of claim 10, wherein the kicker reflector has a rectangular shape.

17. A downlight fixture comprising:

a light-emitting diode (LED) light source for emitting directional light rays in a downward direction towards an illuminated target; and a reflector assembly including a kicker reflector having a reflector wall extending between a small top opening and a large bottom opening along a transverse axis, the reflector wall having an internal surface with an illuminated area and a non-illuminated area, a separator component mounted within the kicker reflector between the illuminated area and the non-illuminated area, and a scoop mounted to the kicker reflector and having a semispherical shape with an internal reflective multi-faceted surface facing both the illuminated area of the kicker reflector and the top opening for reflecting light rays received through the top opening towards the illuminated area, wherein the reflector wall includes a shield plate having a top end below the scoop and a bottom end adjacent to the bottom opening of the kicker reflector, the shield plate being located between the illuminated area and the non-illuminated area of the kicker reflector to block light rays from traveling towards the non-illuminated area.

18. The downlight fixture of claim 10, wherein the scoop covers half of the top opening.

* * * * *